US009580784B2

(12) United States Patent
Sekiya et al.

(10) Patent No.: US 9,580,784 B2
(45) Date of Patent: Feb. 28, 2017

(54) ALUMINUM ALLOY WIRE AND METHOD OF PRODUCING THE SAME

(71) Applicants: FURUKAWA ELECTRIC CO., LTD., Tokyo (JP); FURUKAWA AUTOMOTIVE SYSTEMS INC., Inukami-gun, Shiga (JP)

(72) Inventors: Shigeki Sekiya, Tokyo (JP); Kyota Susai, Tokyo (JP)

(73) Assignees: FURUKAWA AUTOMOTIVE SYSTEMS INC., Shiga (JP); FURUKAWA ELECTRIC CO., LTD., Tokyo (JP)

( * ) Notice: Subject to any disclaimer, the term of this patent is extended or adjusted under 35 U.S.C. 154(b) by 326 days.

(21) Appl. No.: 14/497,744

(22) Filed: Sep. 26, 2014

(65) Prior Publication Data

US 2015/0007910 A1 Jan. 8, 2015

Related U.S. Application Data

(63) Continuation of application No. PCT/JP2013/059758, filed on Mar. 29, 2013.

(30) Foreign Application Priority Data

Mar. 29, 2012 (JP) ..... 2012-075579

(51) Int. Cl.
*H01B 1/02* (2006.01)
*C22F 1/05* (2006.01)
(Continued)

(52) U.S. Cl.
CPC ..... *C22F 1/05* (2013.01); *B21C 1/003* (2013.01); *C22C 21/00* (2013.01); *C22C 21/02* (2013.01);
(Continued)

(58) Field of Classification Search
CPC ..... C21C 21/00; C21C 21/02; C21C 21/08; B21C 1/003; C22F 1/00; C22F 1/04; C22F 1/043; C22F 1/047; C22F 1/05
See application file for complete search history.

(56) References Cited

U.S. PATENT DOCUMENTS

2010/0071933 A1 3/2010 Otsuka et al.
2011/0132659 A1* 6/2011 Kusakari ..... B21C 1/00 174/72 A
(Continued)

FOREIGN PATENT DOCUMENTS

CN 102264929 A 11/2011
JP 2003-321755 A 11/2003
(Continued)

OTHER PUBLICATIONS

Chinese Office Action and Search Report dated Oct. 23, 2015, for Chinese Application No. 201380009185.6 with the English translation.
(Continued)

*Primary Examiner* — Lois Zheng
(74) *Attorney, Agent, or Firm* — Birch, Stewart, Kolasch & Birch, LLP

(57) ABSTRACT

An aluminum alloy wire, having an alloy composition which contains: 0.01 to 1.2 mass % of Fe, 0.1 to 1.0 mass % of Mg, and 0.1 to 1.0 mass % of Si, with the balance being Al and inevitable impurities, in which a grain size is 1 to 30 μm, and in which a dispersion density of $Mg_2Si$ needle precipitate in the aluminum alloy is 10 to 200/$\mu m^2$; and a method of producing the same.

9 Claims, 1 Drawing Sheet

(51) Int. Cl.

| | |
|---|---|
| ***C22C 21/00*** | (2006.01) |
| ***C22F 1/00*** | (2006.01) |
| ***C22F 1/04*** | (2006.01) |
| ***C22C 21/02*** | (2006.01) |
| ***C22C 21/08*** | (2006.01) |
| ***C22F 1/043*** | (2006.01) |
| ***C22F 1/047*** | (2006.01) |
| ***B21C 1/00*** | (2006.01) |
| *H01B 7/00* | (2006.01) |

(52) U.S. Cl.
CPC ..... *C22C 21/08* (2013.01); *C22F 1/00* (2013.01); *C22F 1/04* (2013.01); *C22F 1/043* (2013.01); *C22F 1/047* (2013.01); *H01B 1/023* (2013.01)

(56) References Cited

U.S. PATENT DOCUMENTS

| | | | |
|---|---|---|---|
| 2011/0266029 | A1 | 11/2011 | Sekiya et al. |
| 2012/0217060 | A1 | 8/2012 | Kusakari et al. |
| 2013/0126051 | A1 | 5/2013 | Sekiya et al. |
| 2013/0264115 | A1 | 10/2013 | Kobayashi et al. |

FOREIGN PATENT DOCUMENTS

| | | | |
|---|---|---|---|
| JP | 2008-112620 | A | 5/2008 |
| JP | 2010-163676 | A | 7/2010 |
| JP | 2012-229485 | A | 11/2012 |
| JP | 2013-44038 | A | 3/2013 |
| WO | WO 2011/052644 | A1 | 5/2011 |
| WO | WO 2011/105584 | A1 | 9/2011 |
| WO | WO 2012/008588 | A1 | 1/2012 |

OTHER PUBLICATIONS

Extended European Search Report dated Oct. 28, 2015, issued in corresponding European Patent Application No. 13769381.8.

International Search Report, mailed Jun. 4, 2013, issued in PCT/JP2013/059758.

* cited by examiner

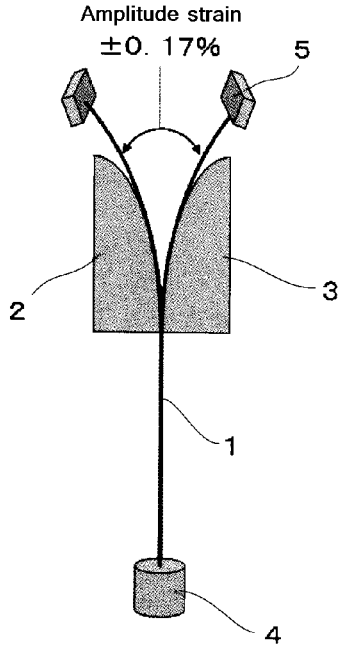
Amplitude strain
±0. 17%
5
2
3
1
4

ALUMINUM ALLOY WIRE AND METHOD OF PRODUCING THE SAME

CROSS-REFERENCE TO RELATED APPLICATIONS

This application is a Continuation of PCT International Application No. PCT/JP2013/059758 filed on Mar. 29, 2013, which claims priority under 35 U.S.C. §119 (a) to Japanese Patent Application No. 2012-075579 filed on Mar. 29, 2012. Each of the above applications is hereby expressly incorporated by reference, in its entirety, into the present application.

TECHNICAL FIELD

The present invention relates to an aluminum alloy wire that is used as a conductor of electrical wirings, and to a method of producing the same.

BACKGROUND ART

Hitherto, a member in which a terminal (a connector) made of copper or a copper alloy (for example, brass) is attached to electrical wires comprised of conductors of copper or a copper alloy, which is called a wire harness, has been used as an electrical wiring for movable bodies, such as automobiles, trains, and aircrafts. Among a means of weight reduction required for movable bodies in recent years, studies have been progressing on use of aluminum or an aluminum alloy that is lighter than copper or a copper alloy, as a conductor for the electrical wiring, in place of the copper or the copper alloy.

The specific gravity of aluminum is about one-third of that of copper, and the electrical conductivity of aluminum is about two-thirds of that of copper (when pure copper is considered as a criterion of 100% IACS, pure aluminum has about 66% IACS). Therefore, in order to pass an electrical current through a conductor wire of pure aluminum, in which the intensity of the current is identical to that through a conductor wire of pure copper, it is necessary to adjust the cross-sectional area of the conductor wire of pure aluminum to about 1.5 times larger than that of the conductor wire of pure copper. Nevertheless, an aluminum conductor wire is still more advantageous in mass than a copper conductor wire, since the former has an about half weight of the latter.

Herein, the term "% IACS" mentioned above represents an electrical conductivity when the resistivity $1.7241\times10^{-8}$ Ωm of International Annealed Copper Standard is defined as 100% IACS.

There are some tasks in using aluminum as a conductor of electrical wirings for movable bodies.

One of the tasks is improvement in resistance to bending fatigue. This is because a repeated bending stress is applied to a wire harness attached to a door or the like, due to opening and closing of the door. A metal material, such as aluminum, is broken at the certain number of times of repeating of applying a load when the load is applied to or removed repeatedly as in opening and closing of a door, even at a low load at which the material is not broken by one time of applying the load thereto (fatigue breakage). When the aluminum conductor is used in an opening and closing part, if the conductor is poor in resistance to bending fatigue, it is concerned that the conductor is broken in the use thereof, to result in a problem of lack of durability and reliability. Generally, a material higher in mechanical strength is said to have more satisfactory resistance to bending fatigue. Thus, it may be considered that it might be favorable to apply an aluminum wire high in mechanical strength. However, on the other hand, a worked product high in mechanical strength is insufficient in elongation, and it is difficult to conduct the installation to vehicles. Thus, in general, annealed products that can secure elongation are utilized in many cases.

Another task is enhancement of tensile strength. This is to maintain the tensile strength of a crimp section in a connection part of a wire and a terminal, and to endure a load that is abruptly applied thereto in installation to a vehicle. Since replacement of copper conductors with aluminum conductors results in an increase in the cross-sectional area as described above, the resistance to applied load [N] is apt to increase. However, a pure aluminum conductor is lower in resistance to applied load [N] than a copper conductor, and it is difficult to replace the copper conductor. Thus, there is a demand for a new wire of an aluminum conductor, which is improved in resistance to applied load per unit area (tensile strength [MPa]).

According to the above, for an aluminum conductor that is used in electrical wirings of movable bodies, a material is required, which is excellent in tensile strength and resistance to bending fatigue, as well as which is excellent in electrical conductivity that is required for passing much electricity.

For applications for which such a demand is exist, ones of pure aluminum-based alloys represented by aluminum alloy wires for electrical power lines (JIS 1060 and JIS 1070) cannot sufficiently tolerate a repeated bending stress that is generated by opening and closing of a door or the like. Further, although an aluminum alloy in which various additive elements are added is excellent in tensile strength, the alloy has such problems that the electrical conductivity is lowered due to solid-solution phenomenon of the additive elements in aluminum, and that wire breaking occurs in wire-drawing due to formation of excess intermetallic compounds in aluminum. Therefore, it is necessary to limit and select additive elements, to prevent wire breakage as an essential feature, as well as to prevent lowering in electrical conductivity, and to enhance mechanical strength and resistance to bending fatigue.

Typical aluminum conductors used in electrical wirings of movable bodies include one described in Patent Literature 1. This is to realize the required tensile strength, elongation at breakage, impact resistance, and the like, by using an electric wire conductor that is formed by stranding a plurality of fine aluminum alloy solid wires.

However, since the aluminum conductor described in Patent Literature 1 is large in a grain size, the aluminum conductor does not satisfy resistance to bending fatigue, and a further improvement has been demanded.

CITATION LIST

Patent Literature

Patent Literature 1: JP-A-2008-112620 ("JP-A" means unexamined published Japanese patent application)

SUMMARY OF INVENTION

The present invention is contemplated for providing an aluminum alloy wire, which has sufficient electrical conductivity and tensile strength, and which is excellent in resistance to bending fatigue.

The inventors of the present invention, having studied keenly, found that an aluminum alloy conductor, which has excellent resistance to bending fatigue, mechanical strength, and electrical conductivity, can be produced, by controlling grain size and $Mg_2Si$ needle precipitate, by employing a specific alloy composition and controlling the production conditions in, such as solution heat treatment and aging. The present invention is attained based on that finding.

That is, according to the present invention, there is provided the following means:

(1) An aluminum alloy wire, having an alloy composition which contains: 0.01 to 1.2 mass % of Fe, 0.1 to 1.0 mass % of Mg, and 0.1 to 1.0 mass % of Si, with the balance being Al and inevitable impurities, wherein a grain size is 1 to 30 μm, and wherein a dispersion density of $Mg_2Si$ needle precipitate in the aluminum alloy is 10 to 200/μm$^2$ (in which the unit is the number of precipitates per square micrometer).

(2) The aluminum alloy wire according to (1), further containing 0.01 to 0.5 mass % of Cu.

(3) The aluminum alloy wire according to (1) or (2), further containing at least one of Ti and B in a total amount of 0.001 to 0.03 mass %.

(4) A method of producing the aluminum alloy wire according to any one of (1) to (3), containing the steps of: melting, casting, hot working, first wire-drawing, first heat treatment, second wire-drawing, second heat treatment, and aging, in this order, wherein the second heat treatment is a solution heat treatment that is conducted by a continuous electric heat treatment, and the conditions therefor satisfy a relationship represented by formulas:

$$0.03 \leq x \leq 0.73, \text{ and}$$

$$22x^{-0.4}+500 \leq y \leq 18x^{-0.4}+560$$

in which x represents an annealing time period (sec), y represents a wire temperature (° C.), and the x in the left side and the right side is the same value.

(5) A method of producing the aluminum alloy wire according to any one of (1) to (3), containing the steps of: melting, casting, hot working, first wire-drawing, first heat treatment, second wire-drawing, second heat treatment, and aging, in this order, wherein the second heat treatment is a solution heat treatment that is conducted by a continuous running heat treatment, and the conditions therefor satisfy a relationship represented by formulas:

$$1.5 \leq x \leq 5, \text{ and}$$

$$-8.5x+612 \leq z \leq -8.5x+667$$

in which x represents an annealing time period (sec), z represents an annealing furnace temperature (° C.), and the x in the left side and the right side is the same value.

(6) The method according to (4) or (5) of producing the aluminum alloy wire, wherein an aging temperature of the aging is 140 to 220° C.

(7) The method according to any one of (4) to (6) of producing the aluminum alloy wire, wherein a degree of working in the second wire-drawing is 3 to 6.

The aluminum alloy wire of the present invention is excellent in the resistance to bending fatigue, the tensile strength, and the electrical conductivity, and is useful as a conductor wire for a battery cable, a harness, or a motor, each of which is mounted on a movable body. Thus, the aluminum alloy wire of the present invention can also be preferably used for a door, a trunk, a hood (or a bonnet), and the like, for which a quite high resistance to bending fatigue is required.

The method of the present invention of producing the aluminum alloy wire is preferable for producing the aluminum alloy wire.

Other and further features and advantages of the invention will appear more fully from the following description, appropriately referring to the accompanying drawings.

BRIEF DESCRIPTION OF THE DRAWING

FIG. 1 is an explanatory view of the test for measuring the number of repeating times at breakage, which was conducted in the Examples.

EMBODIMENTS

The aluminum alloy wire (hereinafter, also referred to as an aluminum wire or an aluminum alloy conductor) of embodiments of the present invention can have excellent resistance to bending fatigue, tensile strength, and electrical conductivity, by specifying the grain size of the aluminum alloy matrix and the $Mg_2Si$ needle precipitate in the aluminum alloy, as follows.

In the aluminum alloy wire of the embodiment, the grain size of the aluminum alloy matrix is 1 to 30 μm. Herein, the term "grain size" means the grain size in a cross-section that is perpendicular to the wire-drawn direction of the aluminum wire. If a metal microstructure in which the grains are too coarse is formed, the deformation behavior becomes non-uniform, and the tensile strength, elongation, and resistance to bending fatigue are conspicuously lowered. There are no specific limitations on the lower limit of the grain size, but in order to distinguish from a worked product, the lower limit is preferably 1 μm or more. The grain size is preferably 1 to 20 μm.

The "grain size" in the embodiment is an average grain size determined by conducting a grain size measurement with an intersection method by observing with an optical microscope, and is an average value of 50 to 100 grains.

In the embodiment, the dispersion density of $Mg_2Si$ needle precipitate formed in the aluminum alloy is adjusted to 10 to 200/μm$^2$. The $Mg_2Si$ needle precipitate is a compound formed via aggregation of Mg and Si among the additive elements, which were not able to be completely solved into the aluminum alloy. Since to form a crystal different from matrix crystals from uniform crystals is referred to as precipitation, the thus-formed compound is called a precipitate. The term "needle" indicates the shape of the precipitate, and refers to a precipitate of a long-and-narrow shape with length 40 to 500 nm, preferably 40 to 400 nm, and maximum transverse width (thickness) 1 to 20 nm. By making the $Mg_2Si$ needle precipitate precipitated in the aluminum alloy, the resistance to bending fatigue and tensile strength can be enhanced, and a lowering of the electrical conductivity can be prevented. If the dispersion density of the $Mg_2Si$ needle precipitate is too low, these effects are insufficient. If the dispersion density is too high, there is a risk, such as a lowering in elongation caused by excessive precipitation, or wire breakage upon wire-drawing. Further, the dispersion density may vary according to the aging conditions. In the case of under the same aging conditions, when the amounts of addition of Mg and Si are large, $Mg_2Si$ needle precipitate is apt to be formed in a larger amount. However, at the same time, since Mg and Si are made into a solid solution in larger amounts, the electrical conductivity becomes lowered. From the viewpoint of electrical conductivity, it is desirable to contain the $Mg_2Si$ needle precipitate in a smaller amount; while, from the viewpoints of high mechanical strength and high bending resistance, it is desirable to contain the $Mg_2Si$ needle precipitate in a larger amount. Taking the above into consideration, the dispersion density of the $Mg_2Si$ needle precipitate is preferably 25 to 150/μm$^2$, more preferably 40 to 125/μm$^2$.

(Alloy Composition and Effects Thereof)

A preferable first typical embodiment of the present invention has an alloy composition (i.e. a structure of alloying elements) contains Al, 0.01 to 1.2 mass % of Fe, 0.1 to 1.0 mass % of Mg, and 0.1 to 1.0 mass % of Si. The balance may contain inevitable impurities.

In this typical embodiment, the content of Fe is set to 0.01 to 1.2 mass %. Fe is added, to utilize various effects by mainly Al—Fe-based intermetallic compound formed. Fe is made into a solid solution in aluminum in an amount of only 0.05 mass % at 655° C., and is made into a solid solution lesser at room temperature. The remainder of Fe is crystallized or precipitated as intermetallic compounds, such as Al—Fe, Al—Fe—Si, and Al—Fe—Si—Mg. The crystallized or precipitated product acts as a refiner for grains to make the grain size fine, and enhances the tensile strength and resistance to bending fatigue. On the other hand, the tensile strength is enhanced also by the solid-solution of Fe. When the content of Fe is too small, these effects are insufficient, and when the content is too large, the resultant aluminum conductor is poor in the wire-drawing property due to coarsening of the precipitated product, and the intended resistance to bending fatigue cannot be obtained. Furthermore, the electrical conductivity is also lowered. The content of Fe is preferably 0.15 to 0.9 mass %, more preferably 0.15 to 0.45 mass %.

In this typical embodiment, the content of Mg is set to 0.1 to 1.0 mass %. Mg is made into a solid solution in the aluminum matrix, to strengthen the resultant alloy. Further, a part of Mg forms a precipitate with Si, to make it possible to enhance tensile strength and to improve resistance to bending fatigue and heat resistance. When the content of Mg is too small, those effects are insufficient, and when the content is too large, electrical conductivity is lowered. If high mechanical strength is considered important, the content of Mg is preferably 0.5 to 1.0 mass %. Alternatively, if electrical conductivity is considered important, the content of Mg is preferably 0.1 to 0.5 mass %, more preferably 0.3 to 0.5 mass %. If it is allowed to further lower the electrical conductivity, the upper limit of the Mg content is not intended to be limited to 1.0 mass %.

In this typical embodiment, the content of Si is set to 0.1 to 1.0 mass %. This is because Si is made into a compound formed with Mg, to act to enhance tensile strength, and to improve resistance to bending fatigue and heat resistance, as described above. When the content of Si is too small, those effects become insufficient, and when the content is too large, the electrical conductivity is lowered. If high mechanical strength is considered important, the content of Si is preferably 0.5 to 1.0 mass %. Alternatively, if electrical conductivity is considered important, the content of Si is preferably 0.1 to 0.5 mass %, more preferably 0.3 to 0.5 mass %. If it is allowed to further lower the electrical conductivity, the upper limit of the Si content is not intended to be limited to 1.0 mass %.

In the Al alloy composition of the embodiment, a preferred second typical embodiment of the present invention further contains 0.01 to 0.5 mass % of Cu, by replacing a part of Al in the alloy composition of the first typical embodiment.

In this typical embodiment, the content of Cu is set to 0.01 to 0.5 mass %, to make Cu into a solid solution in the aluminum matrix, to strengthen the resultant alloy. Thus, Cu contributes to the improvement in creep resistance, resistance to bending fatigue, and heat resistance. When the content of Cu is too small, those effects become insufficient, and when the content is too large, lowering in corrosion resistance and electrical conductivity is caused. If high mechanical strength is considered important, the content of Cu is preferably 0.25 to 0.5 mass %. Alternatively, if electrical conductivity is considered important, the content of Cu is preferably 0.01 to 0.25 mass %. If it is allowed to further lower the electrical conductivity, the upper limit of the Cu content is not intended to be limited to 0.5 mass %.

Other alloy composition (i.e. alloying elements) and the effects thereof are similar to those in the above first typical embodiment.

In the Al alloy composition of the embodiment, a preferred third typical embodiment of the present invention further contains at least one of Ti and B in an amount of 0.001 to 0.03 mass % in total, by replacing a part of Al in the alloy composition of the first typical embodiment or the second typical embodiment.

In this typical embodiment, the content of at least one of Ti and B is set to an amount of 0.001 to 0.03 mass % in total. Ti or B works as a grain refiner in casting, and is capable of enhancing tensile strength and resistance to bending fatigue. When the content of Ti or B is too small, the effects are not sufficiently exhibited, and grains become coarse. On the other hand, when the content of Ti or B is too large, a lowering of electrical conductivity is brought about. The content of Ti or B is preferably 0.015 to 0.03 mass %, if the effect of grain refining is expected, and it is preferably 0.001 to 0.015 mass %, if it is intended not to lower the electrical conductivity so much.

Other alloy composition and the effects thereof are similar to those in the above first and second typical embodiments.

The inevitable impurities described above each are at a level that is usually contained in the production process. Inevitable impurities each serve as a factor that slightly lowers electrical conductivity. Since the inevitable impurities are usually contained in the production process, it is necessary to take a lowering of electrical conductivity into consideration. The inevitable impurities include 0.20 mass % or less of Si, 0.25 mass % or less of Fe, 0.03 mass % or less of Mg, 0.04 mass % or less of Cu, 0.03 mass % or less of Mn, 0.04 mass % or less of Zn, 0.05 mass % or less of V, and 0.03 mass % or less of Ti. For other elements, a content of 0.03 mass % or less is defined as the inevitable impurities. The contents of the inevitable impurities are determined, by making reference to the material of JIS Standard Alloy No. 1070 that is generally used in an aluminum alloy for electrical applications.

An aluminum alloy wire containing those grains and $Mg_2Si$ needle precipitate can be produced, by controlling the alloy composition, and the solution heat treatment conditions, the aging conditions, and the like, in combination. A preferred production method is described below.

(Production Method of the Aluminum Alloy Wire of the Embodiment)

The aluminum alloy wire of the embodiment can be produced via steps of: [1] melting, [2] casting, [3] hot-working (e.g. caliber rolling with grooved rolls), [4] first wire-drawing, [5] first heat-treatment (intermediate annealing), [6] second wire-drawing, [7] second heat-treatment, and [8] aging, in this order. Those steps are described in below.

[1] Melting

The melting is conducted by melting predetermined alloying elements each at a given content that gives the given concentration of each typical embodiment of the aluminum alloy composition mentioned above.

[2] Casting, [3] Hot-Working (e.g. Caliber Rolling with Grooved Rolls)

Then, the resultant molten metal is rolled while the molten metal is continuously cast in a water-cooled casting mold, by using, for example, a Properzi-type continuous cast-rolling machine which has a casting ring and a belt in combination, to give a rod of an appropriate diameter preferably a diameter of 8 to 13 mmϕ, for example, a rod of about 10 mm in diameter. The cooling speed in casting at that time is preferably 1 to 20° C./sec, to prevent coarsening of Fe-based crystallized product and to prevent lowering of electrical conductivity by forced solid-solution of Fe. The cooling speed is not intended to be limited to this range. The casting and hot rolling may be conducted continuously in the manner of the continuous cast-rolling, or alternatively it may be conducted in separate steps, for example, by billet casting and hot extrusion.

[4] First Wire-Drawing

Then, surface stripping of the resultant rod is conducted, as needed, to give a wire rod of an appropriate diameter preferably a diameter of 7.5 to 12.5 mmϕ, for example, about 9.5 mmϕ, and the thus-stripped wire rod is subjected to wire drawing. The degree of working is preferably from 1 to 6. Herein, the degree of working η is represented by: $\eta=\ln(A_0/A_1)$, in which the cross-sectional area of the wire (or rod) before the wire drawing is represented by $A_0$, and the cross-sectional area of the wire after the wire drawing is represented by $A_1$. If the degree of working is too small, in the heat treatment in the subsequent step, the recrystallized grains may be coarsened to conspicuously lower the tensile strength and elongation, which is a cause of wire breakage. If the degree of working is too large, the wire drawing may become difficult, which is problematic in the quality in that, for example, wire breakage occurs in the wire drawing. Although the surface of the wire (or rod) is cleaned up by conducting surface stripping, the surface stripping may be omitted.

[5] First Heat-Treatment (Intermediate Annealing)

The thus-worked product that has undergone cold-wire drawing (i.e. a roughly-drawn wire) is subjected to a first heat-treatment. The first heat-treatment is conducted for mainly recovering the flexibility of the wire that has been hardened by wire drawing. In the case where the intermediate annealing temperature is too high or too low, which result in that wire breakage may occur in the later wire drawing, to fail to obtain a wire. The intermediate annealing temperature is preferably 300 to 450° C., more preferably 350 to 450° C. The time period for intermediate annealing is 10 min or more. If the time period is less than 10 min, the time period required for the formation and growth of recrystallized grains is insufficient, and thus the flexibility of the wire cannot be recovered. The time period is preferably 1 to 6 hours. Furthermore, although the average cooling speed from the heat treatment temperature in the intermediate annealing to 100° C. is not particularly defined, it is preferably 0.1 to 10° C./min.

[6] Second Wire-Drawing

The thus-annealed roughly-drawn wire is further subjected to wire drawing. At this time, the degree of working is set to be from 1.6 to 6.0. The degree of working has a significant influence on the formation and growth of recrystallized grains. If the degree of working is too small, in the heat treatment in the subsequent step, the recrystallized grains may be coarsened to conspicuously lower the tensile strength and elongation, which is a cause of wire breakage. If the degree of working is too large, the wire drawing may become difficult, which is problematic in the quality in that, for example, wire breakage occurs in the wire drawing. To make the grain size finer and to avoid problems such as wire breakage, the degree of working of the second wire-drawing is particularly preferably 3 to 6.0.

[7] Second Heat-Treatment

The thus-worked product that has undergone cold-wire drawing (i.e. a drawn wire) is subjected to a second heat treatment. The second heat treatment can be conducted by either of the two methods: continuous electric heat treatment or continuous running heat treatment. Furthermore, this heat treatment is preferably a solution heat treatment. A solution heat treatment is a heat treatment by which compounds crystallized or precipitated in the aluminum alloy in any of the previous steps are made solved into the aluminum alloy, to make the composition concentration distribution in the resultant alloy uniform.

In conventional solution heat treatments, since the solution heat treatment to make into a solid solution is conducted via a batch-type heat treatment, the resultant grain size is coarsened. When the temperature of the solution heat treatment is set to a low temperature, the resultant grains can be fine in size to a certain extent, but it is difficult to obtain a desired grain size. On the other hand, when the temperature is too low, making into a solid solution becomes incomplete, and age precipitation strengthening upon the subsequent aging is insufficient. In the embodiment, preferably by conducting the solution heat treatment at a high temperature for a short time period, an aluminum alloy wire can be obtained, which is capable of achieving to have fine grains and making into a solid solution, and which is capable of being precipitation strengthened.

The continuous electric heat treatment is to anneal the wire by the Joule heat generated from the wire in interest itself that is running continuously through two electrode rings, by passing an electrical current through the wire. The continuous electric heat treatment has the steps of: rapid heating; and rapid cooling (quenching), and can conduct annealing of the wire, by controlling the temperature of the wire and the time period for the annealing. The cooling (quenching) is conducted, after the rapid heating, by continuously passing the wire through water, the air, or a nitrogen gas atmosphere. Generally, the annealing is conducted by setting an appropriate temperature in a time period within 0.03 to 0.73 seconds. Preferably, to carry out making into a solid solution, the continuous electric heat treatment can be conducted to satisfy the following relationship:

$$0.03 \le x \le 0.73, \text{ and}$$

$$22x^{-0.4}+500 \le y \le 18x^{-0.4}+560$$

wherein y represents the wire temperature (° C.), and x represents the annealing time period (sec), in which the x in the left side and the right side is the same value.

The y (° C.) is generally within the range of 525 to 633 (° C.).

Based on the relationship defined by the above formulas, it is preferable to carry out the solution heat treatment by the continuous electric heat treatment controlled with the heat treatment temperature and time period to very narrow ranges, contrary to the conventional batch-type heat treatment that performs only a softening treatment (annealing).

If either one or both of the wire temperature and the annealing time period are lower or shorter than the conditions defined above, making into a solid solution becomes incomplete, and the amount of the $Mg_2Si$ needle precipitate is reduced, which is precipitated upon aging in the subsequent step. Thus, the enhancement or improvement of tensile strength, resistance to bending fatigue, and electrical conductivity becomes less. However, when the dispersion density of the $Mg_2Si$ needle precipitate falls in a predetermined range, the conditions are met for the embodiment. On the other hand, if either one or both of the wire temperature and the annealing time period are higher or longer than the conditions defined above, the resultant grains are coarsened, and also partial melting (eutectic fusion) of the compound phase in the aluminum alloy wire may occur in some cases. Thus, tensile strength and elongation are lowered, and wire breakage becomes apt to occur in handling of the conductor.

The wire temperature y (° C.) represents the temperature of the wire immediately before passing through the cooling step, at which the temperature of the wire is the highest.

The continuous running heat treatment is to anneal the wire by continuously passing through an annealing furnace maintained at a high temperature. The continuous running heat treatment has the steps of: rapid heating; and rapid cooling, and can conduct annealing of the wire, by controlling the temperature of the annealing furnace and the time period for the annealing. The cooling is conducted, after the rapid heating, by continuously passing the wire through water, the air, or a nitrogen gas atmosphere. Generally, the annealing is conducted by setting an appropriate temperature in a time period within 1.5 to 5.0 seconds. Preferably, to carry out making into a solid solution, the continuous running heat treatment can be conducted to satisfy the following relationship:

$$1.5 \leq x \leq 5, \text{ and}$$

$$-8.5x+612 \leq z \leq -8.5x+667$$

wherein z represents the annealing furnace temperature (° C.), and x represents the annealing time period (sec), in which the x in the left side and the right side is the same value.

The z (° C.) is generally within the range of 570 to 654 (° C.).

Based on the relationship defined by the above formulas, it is preferable to carry out the solution heat treatment by the continuous running heat treatment controlled with the heat treatment temperature and time period to very narrow ranges, contrary to the conventional batch-type heat treatment that performs only a softening treatment.

If either one or both of the annealing furnace temperature and the annealing time period are lower or shorter than the conditions defined above, making into a solid solution becomes incomplete, and the amount of the $Mg_2Si$ needle precipitate is reduced, which is precipitated upon aging in the subsequent step. Thus, the enhancement or improvement of tensile strength, resistance to bending fatigue, and electrical conductivity becomes less. However, when the dispersion density of the $Mg_2Si$ needle precipitate falls in a predetermined range, the conditions are met for the embodiment. On the other hand, if either one or both of the annealing furnace temperature and the annealing time period are higher or longer than the conditions defined above, the resultant grains are coarsened, and also partial melting (eutectic fusion) of the compound phase in the aluminum alloy wire may occur in some cases. Thus, tensile strength and elongation are lowered, and wire breakage becomes apt to occur in handling of the conductor.

Furthermore, besides the above-mentioned two methods, the solution heat treatment may be continuous induction heating-type, by which the wire is annealed by continuously passing through a magnetic field. In this case also, the continuous induction heat treatment has the steps of: rapid heating; and rapid cooling, and can anneal the wire, by controlling the temperature of the wire and the time period for the annealing. The cooling is conducted, after the rapid heating, by continuously passing the wire through water, the air, or a nitrogen gas atmosphere.

The temperature-raising speed (i.e. a heating speed) in the second heat treatment is preferably set to 20° C./s or more. This is because, with this speed less than 20° C./s, since the $Mg_2Si$ compound is precipitated in the mid way of temperature raising and is coarsened as the temperature is higher, making into a solid solution becomes incomplete at the predetermined temperature in the predetermined time period of the second heat treatment, and the amount of the $Mg_2Si$ needle precipitate is reduced, which is precipitated upon the aging in the subsequent step. Thus, the enhancement or improvement of tensile strength, resistance to bending fatigue, and electrical conductivity becomes less. Therefore, the faster the temperature-raising speed, the more preferable. The temperature-raising speed is preferably 50° C./s or more, more preferably 100° C./s or more. By employing the continuous electric heat treatment, continuous running heat treatment, or continuous induction heat treatment, it is possible to produce the wire at the above-mentioned temperature-raising speed.

The cooling speed in the second heat treatment is preferably set to 20° C./s or more. This is because, with this speed less than 20° C./s, since the $Mg_2Si$ compound is precipitated in the mid way of cooling, making into a solid solution becomes incomplete, and the amount of the $Mg_2Si$ needle precipitate is reduced, which is precipitated upon the aging in the subsequent step. Thus, the enhancement or improvement of tensile strength, resistance to bending fatigue, and electrical conductivity becomes less. Therefore, the faster the cooling speed, the more preferable. The cooling speed is preferably 100° C./s or more, more preferably 250° C./s or more. By employing the continuous electric heat treatment, continuous running heat treatment, or continuous induction heat treatment, it is possible to produce the wire at the above-mentioned cooling speed.

[8] Aging

Then, the resultant wire is subjected to aging. The aging is conducted, to precipitate the $Mg_2Si$ needle precipitate. The aging temperature is preferably 140 to 220° C. If this temperature is lower than 140° C., the $Mg_2Si$ needle precipitate cannot be sufficiently precipitated, and the resistance to bending fatigue and electrical conductivity are insufficient. If the aging temperature is higher than 220° C., the $Mg_2Si$ precipitates become coarsened, and electrical conductivity is enhanced, but resistance to bending fatigue is insufficient. In the embodiment, for example, even if $Mg_2Si$ having another shape, such as a spherical shape or a plate shape, is co-exist, it will be acceptable as long as at least the $Mg_2Si$ needle precipitate is precipitated at the density described above and is dispersed in the matrix. If the resistance to bending fatigue is considered important, the aging temperature is preferably 140 to 200° C. Alternatively, if electrical conductivity is considered important, the aging temperature is preferably 175 to 220° C. The aging time period is not particularly limited, because a preferable aging time period varies depending on the aging temperature. In consideration of productivity, a shorter time period is preferred, and the aging time period is preferably 15 hours or less, more preferably 10 hours or less.

The temperature-raising speed of the aging is set to 1° C./s or more.

The cooling speed after the aging is preferably as fast as possible, to prevent fluctuations in the characteristics. Preferably, the cooling speed is 1° C./s or more. However, in view of the production process, in the case where cooling cannot be conducted so fast, it is necessary to set the aging conditions in consideration of occurrence of an increase or a decrease in the amount of the $Mg_2Si$ needle precipitate upon the cooling.

The wire diameter of the aluminum alloy wire (conductor) of the embodiment is not particularly limited and can be appropriately set according to the applications. In the case of a fine wire, the wire diameter is preferably 0.10 to 0.55 mmϕ, and in the case of a medium-fine wire, the wire diameter is preferably 0.8 to 1.5 mmϕ. One of the advantageous of the aluminum alloy wire of the embodiment is that the wire can be used in the form of solid wire fine or narrow in diameter. Alternatively, the aluminum alloy wire of the embodiment can be used in the form of a bundle of a plurality of wires, or a plurality of wires may be bundled and then twisted together, followed by carrying out the steps of [7] second heat treatment and [8] aging.

EXAMPLES

The embodiment will be described in more detail based on examples given below, but the invention is not meant to be limited by these.

Examples and Comparative Examples

Fe, Mg, Si, Cu, Ti, B, and Al in the amounts (mass %), as shown in Table 1, were made into the respective molten metals ([1] melting), to give copper alloy materials, followed by rolling ([3] hot-working) while continuously casting ([2] casting) in a water-cooled casting mold, by using a Properzi-type continuous cast-rolling machine, to give respective rods with diameter about 10 mmϕ. At that time, the cooling speed in casting was 1 to 20° C./sec.

Then, stripping off of the surface of the rods was conducted, to the diameter of about 9.5 mmϕ, followed by wire drawing ([4] first wire-drawing) to attain a given degree of working, respectively. Then, the thus-roughly-cold-drawn wires were subjected to intermediate annealing ([5] first heat-treatment) at a temperature of 300 to 450° C. for 0.5 to 4 hours, followed by wire drawing ([6] second wire-drawing) to a given diameter of 0.43 mmϕ, 0.31 mmϕ, or 0.14 mmϕ.

Then, the resultant wire was subjected to heat treatment ([7] second heat-treatment) under the conditions as shown in Table 1. In the case where the second heat-treatment was conducted via continuous electric heat treatment, the wire temperature y (° C.) was measured at immediately before passing into water, at which the temperature of the wire would be the highest, with a fiber-type radiation thermometer (manufactured by Japan Sensor Corporation). Alternatively, in the case where the second heat-treatment was conducted via continuous running heat treatment, the annealing furnace temperature z (° C.) was measured, which is shown in Table 1. Furthermore, as a conventional manner, in the case where the second heat-treatment was conducted via batch-type heat treatment, the annealing furnace temperature (° C.) was measured, which is shown in Table 1.

Finally, the resultant wire was subjected to aging ([8] aging) under the conditions at a temperature of 140 to 220° C. for a time period of 1 to 15 hours. After the aging, the resultant wire (sample) was taken out from the furnace, followed by cooling in the air.

With respect to the wires thus-prepared in Examples (Ex) according to the embodiment and Comparative examples (Comp ex), the properties were measured according to the methods described below. The results are shown in Table 1.

(a) Dispersion Density of $Mg_2Si$ Needle Precipitate

Each of the wires of Examples and Comparative examples was made into a thin film by an FIB method, and an electron beam was made incident in <001> direction in the aluminum matrix, to observe an arbitrary region, with a transmission electron microscopy (TEM). Regarding $Mg_2Si$ needle precipitate, needle-shaped precipitate with length 40 nm or more, as defined above, was counted from the thus-taken photomicrograph. In this manner, Al—Fe-based precipitate precipitated in a spherical-shape was eliminated. Also, needle precipitate precipitated vertically in the thus-taken photomicrograph was also exempted from being counted. When a precipitate was spread over outside of the measurement region, if a length of 40 nm or more was included in the measurement region, this precipitate was counted into the number of precipitates. The dispersion density of the $Mg_2Si$ needle precipitate was determined, by setting a region in which 40 or more precipitates could be counted, and calculating by using the formula: {dispersion density of $Mg_2Si$ needle precipitate (particles/$\mu m^2$)=the number of $Mg_2Si$ needle precipitate (particles)/region for counting ($\mu m^2$)}. Depending on the case, the region for counting was set, by using a plurality of sheets of the thus-taken photomicrographs. When there were so few precipitates that 40 or more precipitates could not be counted, an area of 1 $\mu m^2$ was set, and the dispersion density in that region was calculated.

The dispersion density of the $Mg_2Si$ needle precipitate was calculated, by defining a sample thickness of the thin film of 0.15 μm as the reference thickness. If the sample thickness is different from the reference thickness, the dispersion density can be calculated by converting the sample thickness relative to the reference thickness, in other words, by multiplying the dispersion density calculated based on the thus-taken photomicrographs, by a ratio (reference thickness/sample thickness). In the Examples and Comparative examples, all the samples were prepared such that the sample thickness was set to about 0.15 μm, by the FIB method.

(b) Grain Size (GS)

The transverse cross-section of the respective wire sample cut out vertically to the wire-drawn direction, was filled with a resin, followed by mechanical polishing and then electrolytic polishing. The conditions of the electrolytic polishing were as follows: polish liquid, a 20% ethanol solution of perchloric acid; liquid temperature, 0 to 5° C.; voltage, 10 V; current, 10 mA; and time period, 30 to 60 seconds. Then, to obtain a contrast of grains, the resultant sample was subjected to anodizing finishing, with 2% hydrofluoroboric acid, under conditions of voltage 20 V, electrical current 20 mA, and time period 2 to 3 min. The resultant microstructure was observed to take a microphotograph by an optical microscope with a magnification of 200× to 400×, and the grain size was measured by an intersection method. Specifically, a straight line was drawn arbitrarily on the thus-taken microphotograph, and the number of intersection points at which the length of the straight line intersected with the grain boundaries was measured, to determine an average grain size. The grain size was evaluated by changing the length and the number of straight lines so that 50 to 100 grains would be counted.

(c) Tensile Strength (TS) and Flexibility (Tensile Elongation at Breakage, El)

Three test pieces for each sample were tested according to JIS Z 2241, and the average value was obtained, respectively. The tensile strength is preferably 100 MPa or more, to maintain the tensile strength of the crimp section in the connection part between the wire and a terminal, and to enable the wire to endure the load that is abruptly applied thereto in the installation to a vehicle.

(d) Electrical Conductivity (EC)

Specific resistivity of three test pieces with length 300 mm for each sample was measured, by using a four-terminal method, in a thermostatic bath kept at 20° C. (±0.5° C.), to calculate the average electrical conductivity therefrom. The distance between the terminals was set to 200 mm. The electrical conductivity is not particularly limited, but the electrical conductivity is preferably 45% IACS or more, more preferably 50% IACS or more. Furthermore, for a wire that is used for applications where electrical conductivity is more weighted than tensile strength, the electrical conductivity is preferably 55% IACS or more.

(e) the Number of Repeating Times at Breakage

As a criterion for the resistance to bending fatigue, a strain amplitude at an ordinary temperature was set to ±0.17%. The resistance to bending fatigue varies depending on the strain amplitude. When the strain amplitude is large, the resultant fatigue life is short, while when small, the resultant fatigue life is long. Since the strain amplitude can be determined by the wire diameter of a wire 1 and the curvature radii of bending jigs 2 and 3, as shown in FIG. 1, a bending fatigue test can be conducted by arbitrarily setting the wire diameter of the wire 1 and the curvature radii of the bending jigs 2 and 3.

Using a reversed bending fatigue test machine manufactured by Fujii Seiki, Co. Ltd. (currently renamed to Fujii, Co. Ltd.), and using jigs that can impart a bending strain of 0.17% to the wire, the number of repeating times at breakage was measured, by conducting repeated bending. The number of repeating times at breakage was measured from 4 test pieces for each sample, and the average value thereof was obtained. As shown in the explanatory view of FIG. 1, the wire 1 was inserted between the bending jigs 2 and 3 that were spaced by 1 mm, and moved in a reciprocate manner along the jigs 2 and 3. One end of the wire was fixed on a holding jig 5 so that bending can be conducted repeatedly, and a weight 4 of about 10 g was hanged from the other end. Since the holding jig 5 moves in the test, the wire 1 fixed thereon also moves, thereby that repeating bending can be conducted. The repeating was conducted under the condition of 100 times per second, and the test machine has a mechanism in which the weight 4 falls to stop counting when the test piece of the wire 1 is broken. In the test, 200,000 or more of the number of repeating times at breakage was judged to pass the criterion. The number of repeating times at breakage is preferably 400,000 or more, more preferably 800,000 or more.

TABLE 1

| | | Composition mass % | | | | | | |
|---|---|---|---|---|---|---|---|---|
| | No. | Mg | Si | Fe | Cu | Ti | B | Al |
| Ex | 1 | 0.15 | 0.20 | 0.20 | — | — | — | Balance |
| | 2 | 0.30 | 0.30 | 0.19 | — | 0.025 | — | |
| | 3 | 0.40 | 0.45 | 0.20 | 0.15 | — | — | |
| | 4 | 0.50 | 0.31 | 0.20 | 0.32 | — | 0.020 | |
| | 5 | 0.25 | 0.25 | 0.30 | — | 0.010 | 0.015 | |
| | 6 | 0.30 | 0.34 | 0.31 | 0.50 | — | — | |
| | 7 | 0.53 | 0.60 | 0.30 | — | 0.005 | — | |
| | 8 | 0.90 | 1.02 | 0.31 | — | 0.005 | 0.005 | |
| | 9 | 0.50 | 0.30 | 0.40 | — | — | — | |
| | 10 | 0.69 | 0.78 | 0.41 | — | — | 0.005 | |
| | 11 | 0.90 | 0.90 | 0.40 | 0.20 | — | — | |
| | 12 | 0.51 | 0.58 | 0.79 | — | — | — | |
| | 13 | 0.70 | 0.69 | 1.01 | 0.35 | — | — | |
| | 14 | 0.30 | 0.35 | 1.20 | 0.10 | — | — | |
| | 15 | 0.45 | 0.30 | 0.41 | — | — | — | |
| | 16 | 0.50 | 0.57 | 0.80 | 0.10 | — | — | |
| | 17 | 0.50 | 0.45 | 0.22 | — | 0.010 | 0.003 | |
| | 18 | 0.50 | 0.57 | 0.22 | — | 0.010 | 0.003 | |
| | 19 | 0.70 | 0.60 | 0.22 | — | 0.010 | 0.003 | |
| | 20 | 0.70 | 0.78 | 0.22 | — | 0.010 | 0.003 | |
| | 21 | 0.50 | 0.50 | 0.22 | 0.20 | 0.010 | 0.003 | |
| Comp ex | 1 | 0.05 | 0.30 | 0.20 | — | — | — | Balance |
| | 2 | 0.30 | 0.05 | 0.20 | — | — | — | |
| | 3 | 0.30 | 0.30 | 0.30 | — | — | — | |
| | 4 | 0.50 | 0.50 | 0.30 | — | — | — | |
| | 5 | 0.50 | 0.50 | 0.30 | — | — | — | |
| | 6 | 0.30 | 0.30 | 0.20 | — | — | — | |
| | 7 | 0.30 | 0.34 | 0.20 | — | 0.010 | 0.005 | |
| | 8 | 0.31 | 0.30 | 0.30 | — | — | — | |
| | 9 | 0.67 | 0.52 | 0.40 | — | 0.02 | 0.004 | |
| | 10 | 0.67 | 0.55 | 0.14 | — | 0.02 | 0.004 | |
| | 11 | 0.70 | 0.50 | — | — | — | — | |

Notes:
'Ex' means Example and 'Comp ex' means Comparative example. The same is applied to hereinafter.

TABLE 1-continued

| | No. | Final diameter mmϕ | [6] 2nd wire-drawing Degree of working | [7] 2nd heat-treatment Manner | Temp y or z (° C.) | Time x (sec) | Heating speed (° C./s) | Cooling speed (° C./s) | [8] Aging conditions Temp (° C.) | Time (hr) |
|---|---|---|---|---|---|---|---|---|---|---|
| Ex | 1 | 0.14 | 5.8 | Con electric | 585 | 0.073 | 100 or more | 100 or more | 175 | 15 |
| | 2 | 0.31 | 4.3 | | 574 | 0.15 | 100 or more | 100 or more | 150 | 10 |
| | 3 | 0.31 | 4.3 | | 560 | 0.36 | 100 or more | 100 or more | 175 | 10 |
| | 4 | 0.31 | 4.3 | | 591 | 0.15 | 100 or more | 100 or more | 140 | 15 |
| | 5 | 0.14 | 5.1 | | 571 | 0.15 | 100 or more | 100 or more | 175 | 5 |
| | 6 | 0.43 | 3.6 | | 595 | 0.030 | 100 or more | 100 or more | 220 | 1 |
| | 7 | 0.31 | 4.3 | | 586 | 0.073 | 100 or more | 100 or more | 175 | 5 |
| | 8 | 0.31 | 1.6 | | 576 | 0.15 | 100 or more | 100 or more | 150 | 15 |
| | 9 | 0.31 | 4.3 | | 603 | 0.073 | 100 or more | 100 or more | 175 | 10 |
| | 10 | 0.31 | 4.3 | | 608 | 0.030 | 100 or more | 100 or more | 150 | 15 |
| | 11 | 0.43 | 3.6 | | 550 | 0.73 | 100 or more | 100 or more | 200 | 1 |
| | 12 | 0.31 | 4.3 | | 612 | 0.030 | 100 or more | 100 or more | 150 | 10 |
| | 13 | 0.43 | 3.6 | | 555 | 0.15 | 100 or more | 100 or more | 175 | 15 |
| | 14 | 0.31 | 2.3 | | 561 | 0.36 | 100 or more | 100 or more | 200 | 2 |
| | 15 | 0.31 | 4.3 | Con running | 615 | 2.6 | 100 or more | 50 | 150 | 5 |
| | 16 | 0.31 | 3.0 | | 608 | 3.8 | 100 or more | 73 | 175 | 5 |
| | 17 | 0.22 | 4.9 | Con electric | 530 | 0.730 | 100 or more | 100 or more | 180 | 8 |
| | 18 | 0.22 | 4.9 | | 550 | 0.36 | 100 or more | 100 or more | 180 | 8 |
| | 19 | 0.31 | 4.3 | | 530 | 0.73 | 100 or more | 100 or more | 180 | 8 |
| | 20 | 0.31 | 4.3 | | 550 | 0.36 | 100 or more | 100 or more | 180 | 8 |
| | 21 | 0.31 | 4.3 | | 530 | 0.73 | 100 or more | 100 or more | 180 | 8 |
| Comp ex | 1 | 0.31 | 4.3 | Con electric | 575 | 0.15 | 100 or more | 100 or more | 175 | 5 |
| | 2 | 0.31 | 4.3 | | 575 | 0.15 | 100 or more | 100 or more | 200 | 1 |
| | 3 | 0.43 | 1.0 | | 585 | 0.073 | 100 or more | 100 or more | 175 | 5 |
| | 4 | — | 6.2 | | Wire breakage in wire-drawing | | | | | |
| | 5 | 0.31 | 4.3 | | 630 | 0.073 | 100 or more | 100 or more | 175 | 5 |
| | 6 | 0.31 | 4.3 | | 585 | 0.073 | 100 or more | 100 or more | 100 | 5 |
| | 7 | 0.31 | 4.3 | | 586 | 0.073 | 100 or more | 100 or more | 265 | 1 |
| | 8 | 0.31 | 4.3 | Con running | 658 | 2.6 | 100 or more | 100 or more | 175 | 5 |
| | 9 | 0.30 | 4.3 | Batch-type | 530 | 10,800 | 0.050 | 11.25 | 160 | 8 |
| | 10 | 0.30 | 4.3 | Con electric | 600 | 1.2 | 100 or more | 8.3 | 160 | 12 |
| | 11 | 0.26 | 4.6 | High-frequency | 560 | 1 | 100 or more | 100 or more | 180 | 8 |

Notes:
'Con electric' means continuous electric heat treatment; 'Con running' means continuous running heat treatment; 'Batch-type' means batch-type heat treatment; and 'High-frequency' means high-frequency heat treatment

| | No. | $Mg_2Si$ needle precipitate/ $\mu m^2$ | GS μm | TS (MPa) | EI (%) | EC (% IACS) | The number of repeating times at breakage ($\times 10^4$ times) |
|---|---|---|---|---|---|---|---|
| Ex | 1 | 19 | 27 | 135 | 14 | 61 | 27 |
| | 2 | 40 | 21 | 162 | 12 | 56 | 51 |
| | 3 | 74 | 15 | 245 | 10 | 54 | 84 |
| | 4 | 11 | 15 | 251 | 13 | 51 | 24 |
| | 5 | 25 | 15 | 186 | 13 | 59 | 40 |
| | 6 | 12 | 11 | 163 | 13 | 57 | 36 |
| | 7 | 94 | 10 | 305 | 6 | 51 | 108 |
| | 8 | 124 | 7 | 374 | 5 | 45 | 122 |
| | 9 | 45 | 10 | 186 | 11 | 56 | 44 |
| | 10 | 108 | 9 | 349 | 5 | 46 | 106 |
| | 11 | 95 | 7 | 301 | 9 | 46 | 91 |
| | 12 | 76 | 5 | 275 | 9 | 49 | 81 |
| | 13 | 120 | 4 | 322 | 8 | 47 | 125 |
| | 14 | 37 | 3 | 190 | 10 | 56 | 55 |
| | 15 | 34 | 18 | 137 | 15 | 54 | 27 |
| | 16 | 88 | 17 | 269 | 8 | 50 | 74 |
| | 17 | 74 | 12 | 275 | 11 | 55 | 85 |
| | 18 | 103 | 16 | 302 | 8 | 54 | 101 |
| | 19 | 143 | 26 | 340 | 8 | 52 | 165 |
| | 20 | 186 | 11 | 385 | 6 | 51 | 203 |
| | 21 | 68 | 22 | 280 | 10 | 55 | 61 |
| Comp ex | 1 | 0 | 45 | 71 | 26 | 59 | 5 |
| | 2 | 2 | 41 | 78 | 25 | 60 | 5 |
| | 3 | 30 | 38 | 160 | 3 | 58 | 8 |
| | 4 | | | Wire breakage in wire-drawing | | | |
| | 5 | 71 | 52 | 98 | 2 | 53 | 8 |
| | 6 | 0 | 16 | 157 | 12 | 55 | 7 |
| | 7 | 0 | 18 | 142 | 12 | 60 | 7 |
| | 8 | 27 | 50 | 90 | 2 | 57 | 7 |
| | 9 | 50 | 65 | 195 | 4 | 52 | 12 |

TABLE 1-continued

| | | | | | | |
|---|---|---|---|---|---|---|
| 10 | 30 | 48 | 205 | 2 | 52 | 7 |
| 11 | 95 | 43 | 270 | 2 | 51 | 16 |

From the results in Table 1, the followings are apparent.

The aluminum alloy wires of Example Test Nos. 1 to 21 each had the dispersion density of the $Mg_2Si$ needle precipitate in the range of 10 to 200/μm$^2$, and the grain size of 1 to 30 μm. Those aluminum alloy wires of Examples according to the embodiment each exhibited the quite large number of repeating at breakage, and each were excellent in resistance to bending fatigue, as well as they each had satisfactory tensile strength, elongation, and electrical conductivity.

On the contrary, in the Comparative examples, at least one of the alloy composition, grain size, dispersion density of $Mg_2Si$ needle precipitate, and production conditions was outside of the range defined in the embodiment. The resultant wires in the Comparative examples each were poor in at least one property in the results. The details are described below.

Comparative example Test No. 1 contained Mg too low that was outside of the range of the alloy composition defined in the embodiment, and Comparative example Test No. 2 contained Si too low was outside of the range of the alloy composition defined in the embodiment. Under these conditions, in Comparative example Test Nos. 1 and 2, the $Mg_2Si$ needle precipitate was not formed sufficiently, coarse grains were formed, and the alloys each were low in tensile strength and small in the number of repeating at breakage. In Comparative example Test No. 3, the degree of working in the second wire-drawing was too low to form coarse grains upon the subsequent second heat treatment, and the number of repeating at breakage was small. In Comparative example Test No. 4, the degree of working in the second wire-drawing was too high to cause wire breakage upon wire-drawing. In Comparative example Test No. 5, the temperature of the continuous electric heat treatment was too high to form coarse grains, and the alloy was low in tensile strength and small in the number of repeating at breakage. In Comparative example Test Nos. 6 and 7, the temperature in the age hardening was too low or too high to form the number of $Mg_2Si$ needle precipitates insufficiently, and the alloys each were small in the number of repeating times at breakage. In Comparative example Test No. 8, the temperature of the continuous running heat treatment was too high to form coarse grains, and the alloy was low in tensile strength and small in the number of repeating times at breakage.

Comparative example Test No. 9 is a comparative example simulating Sample No. 14 of Test 1 of Japanese Patent No. 5155464. Since the solution heat treatment (the step of [7] second heat treatment) was conducted by batch-type heating according to the descriptions in that publication, the solution heat treatment is not one as defined in the embodiment. Under these conditions, in this Comparative example Test No. 9, coarse grains were formed, and the number of repeating times at breakage was small.

Comparative example Test No. 10 is a comparative example simulating Sample No. 2-2 of Test 2 of Japanese Patent No. 5155464. Since the heat treatment time period of the solution heat treatment (the step of [7] second heat treatment) was too long, and since the cooling speed was not described in that publication at all, the solution heat treatment was conducted under too late conditions that have been conventionally used hitherto, which were outside of the range defined in the embodiment. Under these conditions, in this Comparative example Test No. 10, coarse grains were formed, and the number of repeating times at breakage was small.

Comparative example Test No. 11 is a comparative example simulating Example 1 of Japanese Patent No. 5128109. Since that publication does not describe the details on conditions of the heat treatment corresponding to the solution heat treatment (the step of [7] second heat treatment) at all, the solution heat treatment was conducted under the conditions for a high-frequency continuous softening machine, which have been conventionally used hitherto. This Comparative example Test No. 11 was not fallen in the range of the alloy composition defined in the embodiment, since the alloy did not contain Cu at all. Under these conditions, in Comparative example Test No. 11, coarse grains were formed, and the number of repeating times at breakage was small.

Having described our invention as related to the present embodiments, it is our intention that the invention not be limited by any of the details of the description, unless otherwise specified, but rather be construed broadly within its spirit and scope as set out in the accompanying claims.

REFERENCE SIGNS LIST

1 Test piece (wire)
2, 3 Bending jig
4 Weight
5 Holding jig

The invention claimed is:

1. An aluminum alloy wire, having an alloy composition which consists essentially of: 0.01 to 1.2 mass % of Fe, 0.1 to 1.0 mass % of Mg, and 0.1 to 1.0 mass % of Si, optionally 0.01 to 0.5 mass % of Cu, and further optionally at least one of Ti and B in a total amount of 0.001 to 0.03 mass %, with the balance being Al and inevitable impurities, wherein a grain size is 1 to 30 μm, and wherein a dispersion density of $Mg_2Si$ needle precipitate in the aluminum alloy is 10 to 200/μm$^2$.

2. A method of producing the aluminum alloy wire according to claim 1, consisting essentially the steps of: melting, casting, hot working, first wire-drawing, first heat treatment, second wire-drawing, second heat treatment, and aging, in this order, wherein the second heat treatment is a solution heat treatment that is conducted by a continuous electric heat treatment, and the conditions therefor satisfy a relationship represented by formulas:

$$0.03 \leq x \leq 0.73, \text{ and}$$

$$22x^{-0.4}+500 \leq y \leq 18x^{-0.4}+560$$

in which x represents an annealing time period (sec), y represents a wire temperature (° C.), and the x in the left side and the right side is the same value.

3. The method according to claim 2 of producing the aluminum alloy wire, wherein an aging temperature of the aging is 140 to 220° C.

4. The method according to claim 2 of producing the aluminum alloy wire, wherein a degree of working in the second wire-drawing is 3 to 6.

5. A method of producing the aluminum alloy wire according to claim 1, consisting essentially the steps of: melting, casting, hot working, first wire-drawing, first heat treatment, second wire-drawing, second heat treatment, and aging, in this order, wherein the second heat treatment is a solution heat treatment that is conducted by a continuous running heat treatment, and the conditions therefor satisfy a relationship represented by formulas:

$$1.5 \leq x \leq 5, \text{ and}$$

$$-8.5x+612 \leq z \leq -8.5x+667$$

in which x represents an annealing time period (sec), z represents an annealing furnace temperature (° C.), and the x in the left side and the right side is the same value.

6. The method according to claim 5 of producing the aluminum alloy wire, wherein an aging temperature of the aging is 140 to 220° C.

7. The method according to claim 5 of producing the aluminum alloy wire, wherein a degree of working in the second wire-drawing is 3 to 6.

8. The method according to claim 3 of producing the aluminum alloy wire, wherein a degree of working in the second wire-drawing is 3 to 6.

9. The method according to claim 6 of producing the aluminum alloy wire, wherein a degree of working in the second wire-drawing is 3 to 6.

* * * * *